US005619163A

United States Patent [19]

Koo

[11] Patent Number: 5,619,163

[45] Date of Patent: Apr. 8, 1997

[54] BANDGAP VOLTAGE REFERENCE AND METHOD FOR PROVIDING SAME

[75] Inventor: Ronald B. Koo, Mountain View, Calif.

[73] Assignee: Maxim Integrated Products, Inc., Sunnyvale, Calif.

[21] Appl. No.: 644,563

[22] Filed: May 9, 1996

Related U.S. Application Data

[63] Continuation of Ser. No. 406,309, Mar. 17, 1995.

[51] Int. Cl.[6] ..... G05F 1/10

[52] U.S. Cl. ..... 327/539; 327/538; 323/313

[58] Field of Search ..... 327/535, 538, 327/539, 540; 323/313, 315

[56] References Cited

U.S. PATENT DOCUMENTS

| | | | |
|---|---|---|---|
| 3,617,859 | 11/1971 | Dobkin et al. | 323/4 |
| 3,887,863 | 6/1975 | Brokaw | 323/19 |
| 4,249,122 | 2/1981 | Widlar | 323/313 |
| 5,206,581 | 4/1993 | Yoshida | 323/313 |
| 5,352,973 | 10/1994 | Audy | 323/313 |

*Primary Examiner*—Timothy P. Callahan
*Assistant Examiner*—Jung Ho Kim
*Attorney, Agent, or Firm*—Hickman Beyer & Weaver

[57] ABSTRACT

A bandgap voltage reference includes a series connection of a proportional-to-absolute-temperature (PTAT) voltage drop resistor with a $V_{BE}$ voltage drop transistor, such that a bandgap voltage $V_{REF}=V_{PTAT}+V_{BE}$ can be developed across the series connection. The bandgap voltage reference further includes a PTAT current generator having a pair of bipolar transistors which derive their base currents from a base current node between the PTAT voltage drop resistor and the $V_{BE}$ voltage drop transistor. The PTAT current developed by the PTAT current generator is compensated to counteract the effect of the base currents flowing through the PTAT voltage drop resistor. A method for developing a bandgap reference voltage includes the steps of: a) generating a PTAT current with at least two transistors supplied with a base current, wherein the PTAT current is compensated for the effect of the base current; and b) applying the PTAT current to a series connection of a PTAT voltage drop resistor with a bipolar $V_{BE}$ voltage drop transistor, such that a bandgap voltage $V_{REF}+V_{PTAT}+V_{BE}$ can be developed across the series connection as the PTAT current flows through the series connection. The base current for the pair of transistors is derived from a base current node located between the PTAT voltage drop resistor and the $V_{BE}$ voltage drop transistor.

28 Claims, 2 Drawing Sheets

BANDGAP VOLTAGE REFERENCE AND METHOD FOR PROVIDING SAME

This is a continuation of application Ser. No. 08/406,309 filed Mar. 17, 1995, now abandoned.

BACKGROUND OF THE INVENTION

This invention relates generally to analog and mixed signal (analog and digital) integrated circuits, and more particularly to bandgap voltage references used in analog and mixed signal integrated circuits.

Reference voltages are required for a variety of purposes. For example, reference voltages are used in analog to digital (A/D) converters, and in the regulation of d.c. power supplies. A problem inherent with voltage references is that their output voltages tend to be temperature-dependent. This is because active devices, such as transistors, of the circuitry have operating characteristics (e.g. base current and $V_{BE}$) which vary according to temperature. It is, of course, desirable to minimize the temperature-dependency of the voltage reference circuitry to provide a stable reference voltage.

It is known in the art that a "bandgap" voltage reference is quite stable over a range of temperatures. As it is well known to those skilled in the art, the bandgap of a semiconductor is the energy difference between the bottom of the conduction band and the top of the valance band for the semiconductor. Since the bandgap voltage of silicon is 1.2 eV, a bandgap voltage reference of +1.2 volts d.c. is selected as a stable reference voltage for silicon-based transistor and integrated circuit technologies. Bandgap voltage references of the prior art generally operate by summing the base-emitter voltage $V_{BE}$, of a bipolar transistor with a proportional-to-absolute-temperature (PTAT) voltage $V_{PTAT}$, which is typically developed across a PTAT voltage drop resistor.

In FIG. 1*a*, a prior art bandgap voltage reference circuit 10 is illustrated. The voltage reference circuit 10 and variants thereof are commonly known as "Widlar" bandgap circuits. A Widlar bandgap circuit 10 includes a first transistor 12, a second transistor 14, and a third transistor 16. The transistors 12, 14, and 16 are all NPN bipolar transistors. A bandgap reference voltage $V_{REF}$ is developed at a node 18 and is connected to a load 20, such as the aforementioned A/D converter, d.c. power supply, etc. The collector of transistor 12 is coupled to $V_{REF}$ by a resistor 22, and the emitter of transistor 12 is coupled to ground. The base of transistor 12 is coupled to its collector to cause the transistors 12 and 14 to be current mirrors. A resistor 24 couples the collector of transistor 14 to $V_{REF}$, and the base of transistor 14 is coupled to the base of transistor 12 by line 24. The emitter of transistor 14 is coupled to ground by a resistor 26. Transistor 16, which serves as an error-feedback device, has its collector coupled to $V_{REF}$, and its emitter coupled to ground. The base of transistor 16 is coupled to the collector of transistor 14. The Widlar bandgap circuit 10 is powered by a current source 28 coupled to a power supply $V_{cc}$. The size of transistor 14 is made larger than the size of transistor 12 to compensate for the voltage drop across resistor 26. In bipolar technology, a transistor is made larger than another transistor by having a relatively larger emitter. In this instance, the emitter of transistor 14 may be, for example, four, eight, or ten times larger than the emitter of transistor 12.

The Widlar bandgap circuit 10 operates as follows. The circuit 10 creates a bandgap voltage reference $V_{REF}=V_{PTAT}+V_{BE}$ due to the current $I_{PTAT}$ flowing though resistor 22 and transistor 12. The current source 28 attempts to keep a constant current flowing into a node 30. The error transistor 16 takes a certain amount of the current from node 30 and shorts it to ground. The remaining current flows through transistors 12 and 14. When in regulation, the base of transistor 16 is close to the voltage at the base of transistor 14. This allows the transistor 16 to shunt an amount of current such that the total combined current between transistors 12 and 14 is proportional to the absolute temperature ($T_K$). As $T_K$ varies, the current through transistors 12 and 14 varies linearly relative thereto, maintaining the voltage $V_{REF}$ at the desired 1.2 volts d.c. If the voltage on $V_{REF}$ attempts to rise, the current through transistor 16 increases, decreasing the amount of current flowing through transistors 12 and 14 and therefore pulling down on $V_{REF}$. If $V_{REF}$ attempts to drop, the current flowing through transistor 16 decreases, increasing the amount of current flowing through transistors 12 and 14, thereby intending to increase $V_{REF}$ to its regulated 1.2 volts D/C. Therefore, the transistor 16 controls the total current flowing through transistors 12 and 14 to maintain the level of $V_{REF}$, i.e. to cause $I_{PTAT}$ to flow through resistor 22 and transistor 12.

The Widlar bandgap circuit 10 suffers from a built-in error. This is due to the fact that the base current for both transistors 12 and 14 flows through the resistor 22, causing a voltage drop. While the base current is relatively small, it still can produce an error of approximately 200 parts per million per degree Celsius (ppm/° C.) in the regulated voltage $V_{REF}$. While this level of accuracy is satisfactory for certain applications, other high-precision applications, such as a high-precision A/D converter, requires a reference voltage with higher levels of accuracy.

A prior art bandgap voltage reference circuit 32 known as a "Brokaw Cell" is shown in FIG. 1B. The circuit 32 includes a first transistor 34, a second transistor 36, and an error amplifier 38. The collector of transistor 34 is coupled to $V_{cc}$ by a resistor 40, and its emitter is coupled to ground by a resistor 42. The base of transistor 36 is coupled to the base of transistor 34. The collector of transistor 36 is coupled to $V_{cc}$ by a resistor 44 and the emitter of transistor 36 is coupled to ground by the series connection of a resistor 46 with the aforementioned resistor 42. The inputs of the error amplifier 38 are coupled to the collectors of transistors 34 and 36 and the output of error amplifier 38 develops the reference voltage $V_{REF}$ at a node 48. A load 50 is coupled between the output node 48 and ground. The output of the error amplifier 38 is also fed-back to the bases of transistors 34 and 36 by a line 52, i.e. the output of the error amplifier provides the base currents for transistors 34 and 36.

With the Brokaw cell 32, the transistor 36 is again larger than the transistor 34 to allow an equalization of the currents flowing through those two transistors. In operation, and if resistors 40 and 44 are of the same value, the error amplifier 38 attempts to regulate the current so that equal current flows through transistors 34 and 36. The current through these two transistors is proportional to the absolute temperature in Kelvin ($T_K$). The voltage drop across resistor 42, plus the voltage drop $V_{BE}$ of transistor 34 is used to generate the bandgap voltage $V_{REF}$. The Brokaw cell 32 does not suffer from the aforementioned base current error problem of the Widlar bandgap circuit, because the base currents are supplied by the error amplifier 38, not through a PTAT voltage drop resistor.

The Brokaw cell does, however, have a significant drawback in that it requires considerable "head room," (i.e. the voltage differential between $V_{cc}$ and $V_{REF}$) for proper operation. Since the Brokaw cell 32 typically requires at least 1 volt of head room, this limits the Brokaw cell technology to applications wherein $V_{cc}$ is greater than about 2.2 volts. This means that it is difficult to "bootstrap" a Brokaw Cell by powering the cell with its own output $V_{REF}$. It is desirable to have a bootstrapped bandgap voltage reference since it is more stable than a bandgap voltage reference operating from $V_{cc}$ or some other voltage source. This is because, almost by definition, the bandgap voltage reference is the most temperature-stable voltage source available to power the circuit. While it is possible to provide a bootstrapped Brokaw Cell, such a cell is quite complex in design, and requires a considerable amount of valuable real estate on the integrated circuit. The aforementioned Widlar bandgap circuit is a bootstrap circuit, but that advantage is overshadowed by the error caused by the base current flowing through the PTAT voltage drop resistor.

SUMMARY OF THE INVENTION

The present invention provides a bootstrapped bandgap voltage reference circuit or "core" that is accurate, small in size, and includes few components. This is accomplished by providing compensation for the base current error generated at a PTAT voltage drop resistor.

Briefly, the present invention includes a series connection of a proportional-to-absolute-temperature (PTAT) voltage drop resistor with a $V_{BE}$ voltage drop transistor, such that a bandgap voltage can be developed across the series connection. The invention further includes a PTAT current generator having a pair of bipolar transistors which derive their base currents from a base current node between the PTAT voltage drop resistor and the $V_{BE}$ voltage drop transistor. The PTAT current generator is coupled to the series connection to provide a PTAT current which flows through the series connection. The PTAT current is compensated by the PTAT current generator to counteract the effect of the base currents flowing through the PTAT voltage drop resistor.

More particularly, a bootstrapped bandgap voltage reference of the present invention includes a series connection of a PTAT voltage drop resistor with a bipolar $V_{BE}$ voltage drop transistor, such that a bandgap voltage $V_{REF}=V_{PTAT}+V_{BE}$ can be developed across the series connection when a PTAT current $I_{PTAT}$ flows through the series connection. A first node of the PTAT voltage drop resistor is coupled to a $V_{REF}$ output node, a second node of the PTAT voltage drop resistor is coupled to a base current node, a first node of the $V_{BE}$ voltage drop transistor is coupled to the base current node, and a second node of the $V_{BE}$ voltage drop transistor is coupled to ground.

As mentioned previously, the bootstrapped bandgap voltage reference further includes a PTAT current generator coupled to the $V_{REF}$ node to provide the PTAT current to the series connection. The PTAT current generator includes a first bipolar transistor of a first size, and a second bipolar transistor of a second size greater than the first size. A base of the first bipolar transistor is coupled to the base current node of the series connection, and a base of the second bipolar transistor is coupled to the base current node by a base-current compensating resistor which compensates the PTAT current to counteract the effect of base current for the first transistor and the second transistor flowing through the PTAT voltage drop resistor to the base current node.

A method for developing a bandgap reference voltage in accordance with the present invention comprises the steps of: a) generating a PTAT current with at least two transistors supplied with a base current, wherein the PTAT current is compensated for the effect of the base current; and b) applying the PTAT current to a series connection of a PTAT voltage drop resistor with a bipolar $V_{BE}$ voltage drop transistor, such that a bandgap voltage $V_{REF}=V_{PTAT}+V_{BE}$ can be developed across the series connection as the PTAT current flows through the series connection, wherein the base current for the pair of transistors is derived from a base current node located between the PTAT voltage drop resistor and the $V_{BE}$ voltage drop transistor.

A method for making an integrated circuit in accordance with the present invention includes the steps of: a) designing an integrated circuit including at least one bootstrapped bandgap voltage reference as described above; and b) subsequently manufacturing the integrated circuit according to the design. More particularly, the method includes a step of selecting a value for the base-current compensating resistor by the relationship R4=2(R2)/P, where R4 is the resistance of the base current compensating resistor, R2 is a resistance of a resistor coupling an emitter of the second transistor to ground, and P is the ratio of the emitter sizes of the $V_{BE}$ voltage drop transistor to the first transistor.

An advantage of the present invention is that a much more accurate bandgap reference voltage can be provided than with prior art Widlar bandgap circuits or prior art non-bootstrapped Brokaw Cells. The bandgap voltage reference of the present invention can provide a 100 ppm/°C. or better accuracy, as opposed to a typical 200 ppm/°C. accuracy for prior art Widlar bandgap circuits. Accordingly, the error in the bandgap voltage reference is less than about 100 ppm/°C.

Another advantage of this present invention is that it can be bootstrapped without the circuit complexity required of a bootstrapped Brokaw Cell. In consequence, bandgap reference voltages can be developed by the present invention that equal or exceed the accuracy of bootstrapped Brokaw Cells with much less circuitry.

These and other advantages of the present invention will become apparent to those skilled in the art upon a reading of the following descriptions of the invention and a study of the several figures of the drawing.

DETAILED DESCRIPTION OF THE PREFERRED EMBODIMENTS

Figure 1A:
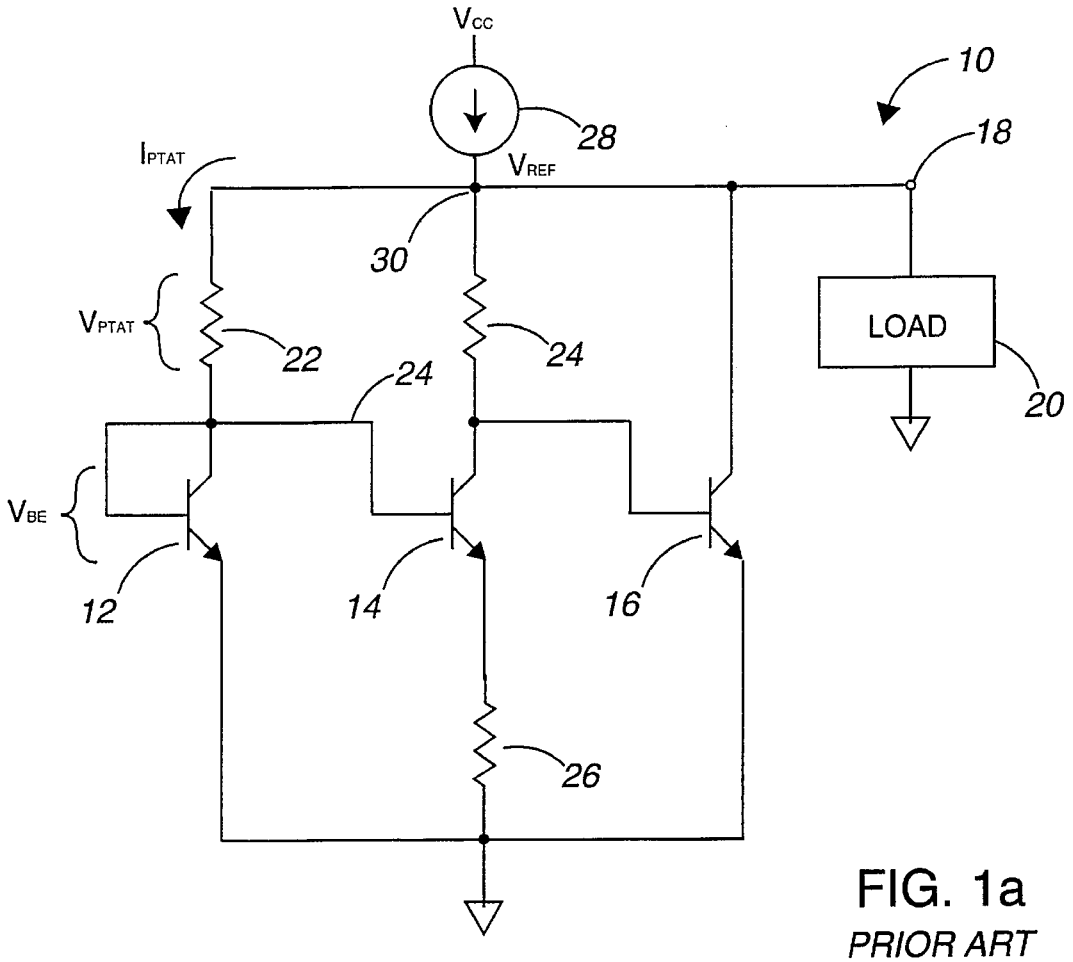
FIG. 1a PRIOR ART
FIG. 1*a* is a schematic diagram of a prior art bandgap voltage reference known as a Widlar bandgap circuit.
Figure 1B:
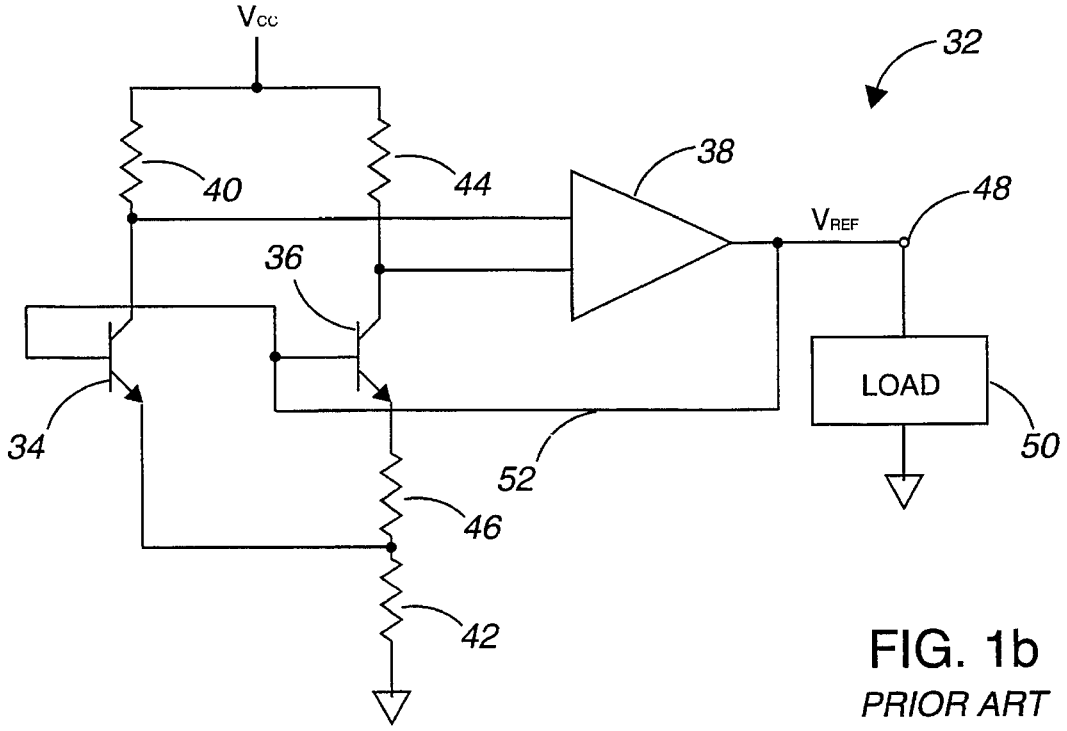
FIG. 1b PRIOR ART
FIG. 1*b* is a schematic diagram of a prior art bandgap voltage reference known as a Brokaw Cell.
Figure 2:
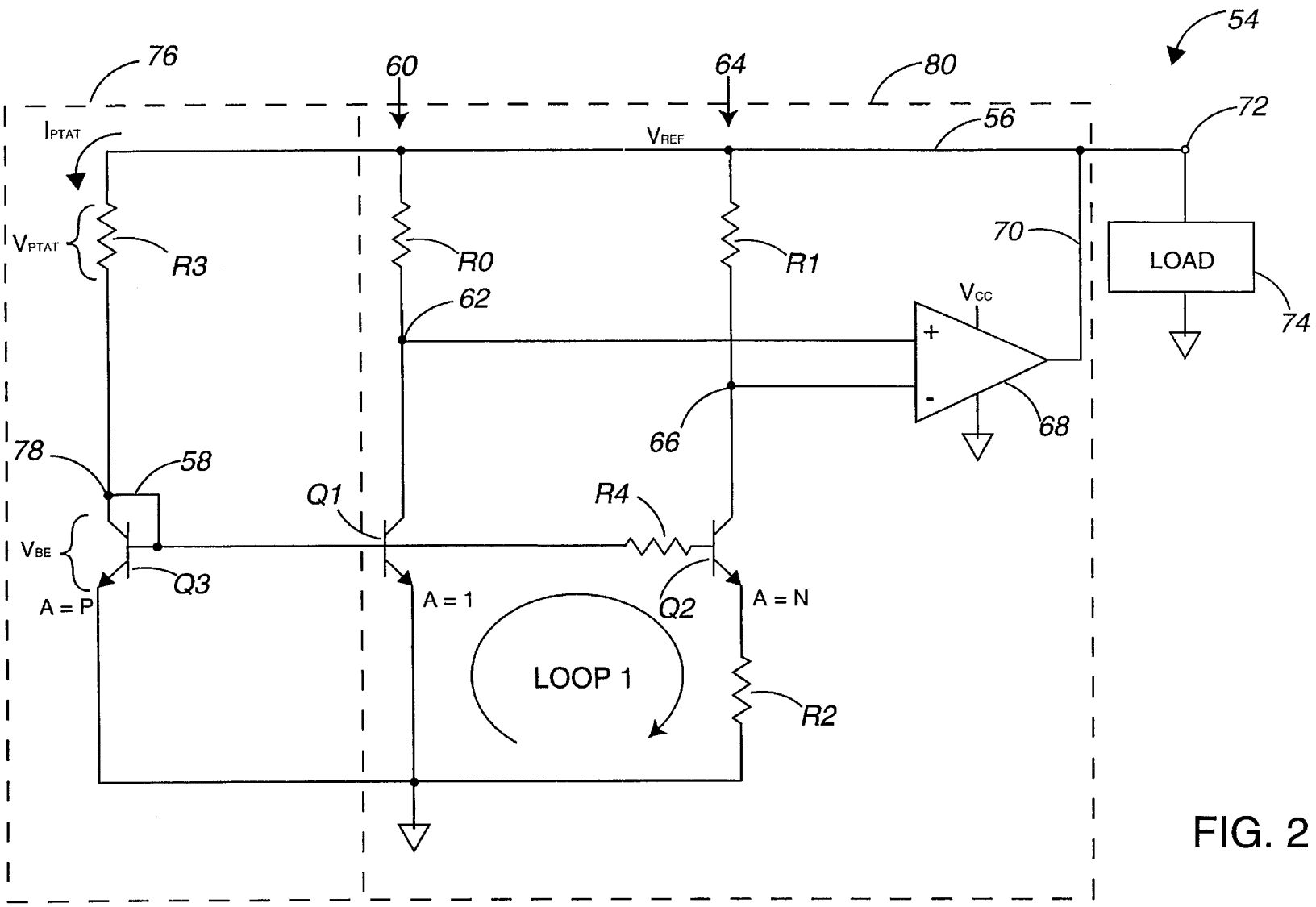
FIG. 2 is a schematic diagram of a bandgap voltage reference circuit in accordance with the present invention.

FIGS. 1*a* and 1*b* were discussed with reference to the prior art. In FIG. 2, a bandgap voltage reference circuit ("core") 54 of the present invention includes a first transistor Q1, a second transistor Q2, and a third transistor Q3. The size or the area "A" of the emitter of transistor Q1 is given as a relative size ("A=1"), i.e. the sizes of other transistors will be referenced to the size of the transistor Q1. The size or area A the emitter of Q2 is A=N, where N>1. An emitter value for Q2 that is 2 to 20 times larger than the emitter value of Q1 is suitable. Also, an emitter value for Q2 that is one of about 4, 8, and 10 times larger than the emitter value of transistor Q1 is also suitable. The size or emitter area of transistor Q3 is A=P where P can be greater than, equal to, or less than 1, i.e. the size of the transistor Q3 is determined by other factors not relevant to the present discussion. The design and manufacture of bipolar transistors of different sizes is well known to those skilled in the art.

The collector of transistor Q3 is coupled to a bandgap voltage reference ($V_{REF}$) line 56 by a PTAT voltage drop R3. The collector and base of transistor Q3 are coupled together by a line 58, and the emitter of transistor Q3 is coupled to ground. It will be recognized by those skilled in the art that the transistors Q3 and Q1 are therefore coupled together in a current-mirror configuration. When a current $I_{PTAT}$ flows through resistor R3 and transistor Q3, a voltage drop of $V_{PTAT}$ is developed across the resistor, and a voltage drop of $V_{BE}$ is developed across the transistor. The sum of these two voltage drops equal the bandgap reference voltage $V_{REF}$, i.e. $V_{REF}=V_{PTAT}+V_{BE}$.

A first transistor stage 60 includes the series connection of a collector resistor R0 with the transistor Q1. The base of transistor Q1 is coupled to the base of transistor Q3 and, therefore, the amount of current flowing through transistor Q1 is related to the amount of current flowing through transistor Q3 due to the current-mirror configuration. More particularly, the amount of current flowing through Q1 is 1/P times the current flowing through Q3, where P is the ratio of the emitter sizes of Q3 to Q1. The collector resistor R0 is coupled between the $V_{REF}$ line 56 and a node 62, the collector of transistor Q1 is coupled to the node 62, and the emitter of transistor Q1 is coupled to ground. A second transistor stage 64 includes a series connection of a collector resistor R1, the transistor Q2, and a resistor R2. More particularly, the collector resistor R1 is coupled between the $V_{REF}$ line 56 and a node 66, the collector of transistor Q2 is coupled to node 66, and the emitter of transistor Q2 is coupled to ground by resistor R2.

The base of transistor Q2 is coupled to the base of transistor Q1 by a base current compensating resistor R4. As will be discussed in greater detail subsequently, the compensating resistor R4 compensates for the error produced by the base current for transistors Q1 and Q2 flowing through resistor R3. By providing the resistor R4 in combination with the transistors Q1 and Q2, an uncomplicated, efficient, and highly accurate bandgap voltage reference circuit is provided.

An error amplifier 68 is coupled to the collectors of transistors Q1 and Q2. More particularly, the "+" input to error amplifier 68 is coupled to node 62, and the "–" input to error amplifier 68 is coupled to node 66. The error amplifier 68 is coupled to $V_{cc}$ (typically 5 or 3 volts d.c.) and to ground. The error amplifier 68 is essentially a linear voltage amplifier, the construction of which is well known to those skilled in the art. The output of error amplifier 68 is coupled to $V_{REF}$ line 56 by a line 70. The error amplifier 68 therefore provides the current for the bandgap voltage reference 54 of the present invention.

The output of the bandgap voltage reference circuit 54 can be found at a $V_{REF}$ output node 72. A load 74 is coupled to node 72 and to ground and uses the voltage reference $V_{REF}$. Typically, the load 74 is also coupled to other power supply voltage levels.

The bandgap voltage reference circuit 54 of the present invention operates as follows. Transistors Q3 and Q1 are current-mirrors, as explained previously. A proportional-to-absolute-temperature current is generated through resistor R2, which is used to develop the PTAT current $I_{PTAT}$ flowing through resistor R3 and transistor Q3. If the currents through transistors Q1 and Q2 are kept in a constant ratio over temperature, then a PTAT voltage drop is generated across R2. In consequence, a PTAT current will flow through transistors Q1, Q2, and Q3, including $I_{PTAT}$ through resistor R3 and transistor Q3. Again, the transistor Q2 is sized larger than the transistor Q1 by a factor N to compensate for the resistance of resistor R2. If the resistances of resistors R0 and R1 are the same, the error amplifier 68 will attempt to regulate $V_{REF}$ so that the currents flowing through first transistor stage 60 and second transistor 64 are about the same.

If, for example, the voltages at nodes 62 and 66 become unbalanced, the error amplifier 68 will vary the current in line 70 in order to compensate. For example, if the voltage at node 62 is greater than the voltage at node 66, the error amplifier 68 will increase the current flowing through lines 70 and 56, thereby increasing the current through all three transistors Q1, Q2, and Q3. Some of this additional current will flow through resistor R3 and transistor Q3. Since transistors Q3 and Q1 are mirrored, additional current will flow through the transistor stage 60 relative to the transistor stage 64, causing an increased voltage drop across resistor R0 thereby lowering the voltage at node 62. If the voltage at node 62 is less than the voltage at node 66, the error amplifier 68 produces less current, which will decrease the current flowing through transistor Q1 more than the current flowing through transistor Q2. This, in turn, will raise the voltage level at node 62, bringing the circuit 54 back into equilibrium.

As noted, the base current for transistors Q1 and Q2 flow through resistor R3. As described previously with reference to the prior art, this would, if uncompensated, cause an error voltage in $V_{PTAT}$, which creates a corresponding error in the voltage level $V_{REF}$. However, the present invention includes a base current compensator which, to a first order approximation, counteracts this error voltage across resistor R3 by producing an equal but opposite current effect in $I_{PTAT}$. The PTAT voltage across resistor R2 is reduced by an amount that is proportional to the base current flowing through resistor R4. Therefore, the PTAT currents can be reduced by an amount equal to the base currents through transistors Q1 and Q2 if resistor R4 is chosen correctly. The base current compensator in the present invention includes the resistor R4 coupled between the bases of transistors Q1 and Q2.

As seen in FIG. 2, a current loop LOOP 1 helps counteract the error caused by the base current flowing to transistors Q1 and Q2 through resistor R3. Due to the compensating resistor R4, there is a voltage drop between the base of transistor Q1 and the base of transistor Q2. This reduces the voltage at the base of transistor Q2, therefore causing the transistor Q2 to pull less current through transistor R1. Since less current is flowing through resistor R1, less current must flow through resistor R3, creating a smaller voltage drop. This voltage drop across resistor R3 causes a compensation in the opposite direction of the original voltage drop error. Therefore, to a first order of approximation, the resistance R4 cancels out the effect of the base currents flowing through transistors Q1 and Q2.

The selection of the values for the various components is application-specific, as will be appreciated by those skilled in the art. However, the values of some of the components are related to the values of other of the components. For example, the value of R0 is related to the value of R3 as follows: R0=P(R3), where P is the relative sizes of transistors Q3 and Q1. The value of R1 is again application specific, although in the present preferred embodiment R1=R0 so that the current flowing through transistors Q1 and Q2 is the same. The value of R2 is chosen by the circuit designer to provide an appropriate amount of current through transistor Q2 to meet circuit specifications. In the present embodiment, a value of 27KΩ is used.

The value of resistor R3 is also calculated based upon system requirements. For example, for a 1.2 volt bandgap reference voltage, if 0.6 volts is dropped across Q3, 0.6 volts should be dropped across R3. Therefore, using Ohm's Law, R3 should have the value of: $R3=0.6/I_{3,ideal}$. The derivation of $I_{3,ideal}$ is set forth below.

The effect of the compensating resistor R4 is important to the error-cancelling feature of the present invention. As mentioned above, the values and configurations of the various components of the circuit can vary depending upon system requirements. However, as derived below, there is a relationship between an appropriate value for resistor R4, given the value of R2 and the sizes of transistors Q3 and Q2.

Derivation of Value of Base-Current Compensating Resistor R4

The $V_{BE}$ compensating resistor R4, as explained previously, counteracts the effect of the base current flowing through R3 to the transistors Q1 and Q2 by (in a first order approximation) producing an equal but opposite effect. It is therefore important to choose a value for R4 that minimizes the error in the bandgap voltage to an acceptable level. The value of R4 can be calculated as derived below.

Assume R0=R1. The collector currents of Q1 and Q2, $I_{c1}$ and $I_{c2}$, respectively, are equal because of the feedback provided by the amplifier. If the βs of Q1 and Q2 are the same, then the emitter currents $I_{E1}$ and $I_{E2}$ of Q1 and Q2, respectively, are also equal. Kirchoff's voltage law can be applied around loop 1:

$$-V_{BE1}+I_{B2}(R4)+V_{BE2}+I_{E2}(R2)=0$$

$$I_{E2}=[V_{BE1}-V_{BE2}-I_{B2}(R4)]/R2$$

where $V_{BE1}$ is the base-emitter voltage of Q1, $I_{B2}$ is the base current of Q2, and $V_{BE2}$ is the base-emitter voltage of Q2. The base-emitter voltage, $V_{BE}$ of a bipolar transistor can be approximated from the following expression:

$$V_{BE}=[(kT)/q]\ln(Ic/Is)$$

where Ic is the collector current, k is Boltzmann's constant, T is the temperature in Kelvin, q is the charge on an electron, and Is is a constant used to describe the transfer characteristic of the transistor in the forward-active region. From the forgoing, $I_{E2}$ can be calculated as:

$$I_{E2}=\{[(kT)/q]\ln N-I_{B2}(R4)\}/R2$$

where N is the ratio of the emitter area of Q2 to the emitter area of Q1. The emitter current of Q3, $I_{E3}$, is a multiple P of $I_{E3}$. $I_{ES}$ can be calculated as follows:

$$I_{E3}=PI_{E2}=P\{[(kT)/q]\ln N-I_{B2}(R4)\}/R2$$

$I_3$, the current flowing through resistor R3, is given by:

$$I_3=I_{E3}+I_{B1}+I_{B2}$$

where $I_{B1}$ is the base current of Q1. Ideally, a PTAT current should flow through R3 as follows:

$$I_{3,ideal}=P\{[(kT)/q]\ln N\}/R2$$

By setting $I_3=I_{3,ideal}$, the following relationship is created:

$$P\{[(kT)/q]\ln N\}/R2=\{P\{[(kT)/q]\ln N-I_{B2}(R4)\}/R2\}+I_{B1}+I_{B2}$$

which reduces to:

$$PI_{B2}(R4/R2)=I_{B1}+I_{B2}$$

If the β is the same for both transistors Q1 and Q2, then $I_{B1}=I_{B2}$. Therefore, in order to cancel the base currents (to a first order approximation), the required R4 is therefore given by:

$$R4=2(R2)/P$$

Early voltage errors can be eliminated if R0=R1=P(R3), resulting in $V_{CB1}=V_{CB2}\approx V_{CB3}$. $V_{BC1}$ is the collector-base voltage of Q1, $V_{CB2}$ is the collector-base voltage of Q2, and $V_{CB3}$ is the collector-base voltage of Q3. It should also be noted that the VBG voltage is less dependent on the input bias current required of a discrete amplifier.

As noted from the forgoing, a bandgap voltage reference 54 includes a series connection 76 of a PTAT voltage drop resistor R3 and a $V_{BE}$ voltage drop transistor Q3. The bandgap voltage $V_{REF}$ is equal to the sum of $V_{PTAT}$ (the voltage across resistor R3) and $V_{BE}$ (the voltage across transistor Q3). A base current node 78 of the series connection 76 supplies base current to transistors Q1 and Q2. The bandgap voltage reference 54 also includes a PTAT current generator 80 including stages 60 and 64, resistor R4, and the error amplifier 68. More particularly, the PTAT current generator 80 includes the pair of transistors Q1 and Q2 and resistor R4 which, in combination, cream the current of LOOP 1, which compensates for the effect of the base currents for transistors Q1 and Q2 that flows through resistor R3. This current of LOOP 1 compensates for the effect of said base current flowing through said PTAT voltage drop resistor by applying an equal but opposite compensating current through said PTAT voltage drop resistor.

As will be apparent from the forgoing, a method for developing a bandgap reference voltage includes the steps of: a) generating a PTAT current with at least two transistors supplied with a base current, where the PTAT current is compensated for the effect of the base current of the two transistors; and b) applying the PTAT current to a series connection of a PTAT voltage drop resistor with a bipolar $V_{BE}$ voltage drop transistor, such that a bandgap voltage of $V_{REF}=V_{PTAT}+V_{BE}$ is developed across the series connection as the PTAT current flows through the series connection. The base current from the two transistors is derived from a node located between the PTAT voltage drop resistor and the $V_{BE}$ voltage drop transistor.

A method for making an integrated circuit in accordance with the present invention includes designing a bootstrapped bandgap voltage reference as described above, and manufacturing an integrated circuit including at least one of the bootstrapped bandgap voltage references. The method also includes a determination of the values of the various resistors as set forth previously.

While this invention has been described in terms of several preferred embodiments, it is contemplated that alternatives, modifications, permutations and equivalents thereof will become apparent to those skilled in the art upon a reading of the specification and study of the drawings. It is therefore intended that the following appended claims include all such alternatives, modifications, permutations and equivalents as fall within the true spirit and scope of the present invention.

What is claimed is:

1. A bandgap voltage reference circuit, comprising:

a series connection of a PTAT voltage drop resistor with a $V_{BE}$ voltage drop transistor, such that a bandgap voltage $V_{REF}=V_{PTAT}+V_{BE}$ can be developed across said series connection, said $V_{PTAT}$ equals a voltage drop across said PTAT voltage drop resistor and said $V_{BE}$ equals a voltage drop across said $V_{BE}$ voltage drop transistor; and a PTAT current generator including a pair of bipolar transistors which derive their base currents from a base current node between said PTAT voltage drop resistor and said $V_{BE}$ voltage drop transistor, a first bipolar transistor of said pair of bipolar transistor having an emitter coupled directly to an emitter of said $V_{BE}$ voltage drop transistor, said PTAT current generator being coupled to said series connection to provide a PTAT current to flow through said series connection, said PTAT current being compensated by said PTAT current generator to counteract an effect of said base currents flowing through said PTAT voltage drop resistor.

2. A bandgap voltage reference circuit as recited in claim 1 wherein a first node of said PTAT voltage drop resistor is coupled to a $V_{REF}$ output node, a second node of said PTAT voltage drop resistor is coupled to said base current node, a collector of said $V_{BE}$ voltage drop transistor is coupled to said base current node.

3. A bandgap voltage reference circuit as recited in claim 2 wherein said first bipolar transistor has a first size and a second bipolar transistor of said pair of bipolar transistors has a second size greater than said first size, wherein a base of said first bipolar transistor is coupled to said base current node, and wherein a base of said second bipolar transistor is coupled to said base current node by a base-current compensating resistor which compensates said PTAT current to counteract said effect of said base currents flowing through said PTAT voltage drop resistor.

4. A bandgap voltage reference circuit as recited in claim 3 further comprising an error amplifier having inputs coupled to said pair of bipolar transistors and an output coupled to said $V_{REF}$ output node.

5. A bandgap voltage reference circuit as recited in claim 4 wherein a collector of said first bipolar transistor is coupled to said $V_{REF}$ output node by a first resistor, a collector of said second transistor is coupled to said $V_{REF}$ output node by a second resistor, and an emitter of said second transistor is coupled to a ground by a third resistor, wherein a first input of said error amplifier is coupled to said collector of said first bipolar transistor, and wherein a second input of said error amplifier is coupled to said collector of said second bipolar transistor.

6. A bootstrapped bandgap voltage reference circuit comprising:

a series connection of a PTAT voltage drop resistor with a bipolar $V_{BE}$ voltage drop transistor, such that a bandgap voltage $V_{REF}=V_{PTAT}+V_{BE}$ can be developed across said series connection when a PTAT current flows through said series connection, said $V_{PTAT}$ equals a voltage drop across said PTAT voltage drop resistor and said $V_{BE}$ equals a voltage drop across said $V_{BE}$ voltage drop transistor, wherein a first node of said PTAT voltage drop resistor is coupled to a $V_{REF}$ output node, a second node of said PTAT voltage drop resistor is coupled to a base current node, a first node of said $V_{BE}$ voltage drop transistor is coupled to said base current node, and a second node of said $V_{BE}$ voltage drop transistor is coupled to a ground; and a PTAT current generator coupled to said $V_{REF}$ output node to provide said PTAT current to flow through said series connection, said PTAT current generator including a first bipolar transistor of a first size, and a second bipolar transistor of a second size greater than said first size, wherein a base of said first bipolar transistor is coupled to said base current node, an emitter of said first bipolar transistor being coupled directly to said second node of said $V_{BE}$ voltage drop transistor, and wherein a base of said second bipolar transistor is coupled to said base current node by a base-current compensating resistor which compensates said PTAT current to counteract an effect of base current for said first transistor and said second transistor flowing through said PTAT voltage drop resistor to said base current node.

7. A bootstrapped bandgap voltage reference circuit as recited in claim 6 wherein said $V_{BE}$ voltage drop transistor is configured to serve as a current mirror in conjunction with said first bipolar transistor.

8. A bootstrapped bandgap voltage reference circuit as recited in claim 7 wherein said $V_{BE}$ voltage drop transistor is an NPN transistor with an emitter representing said second node of said $V_{BE}$ voltage drop transistor, and a collector representing said first node of said $V_{BE}$ voltage drop transistor, and a base coupled to said base current node.

9. A bootstrapped bandgap voltage reference circuit as recited in claim 7 wherein a collector of said first bipolar transistor is coupled to said $V_{REF}$ output node by a first resistor, a collector of said second bipolar transistor is coupled to said $V_{REF}$ output node by a second resistor, and an emitter of said second bipolar transistor is coupled to said ground by a third resistor.

10. A bootstrapped bandgap voltage reference circuit as recited in claim 9 wherein said first bipolar transistor and said second bipolar transistor are NPN transistors.

11. A bootstrapped bandgap voltage reference circuit as recited in claim 9 further comprising an error amplifier having inputs coupled to said first bipolar transistor and said second bipolar transistor and an output coupled to said $V_{REF}$ output node, wherein a first input of said error amplifier is coupled to said collector of said first bipolar transistor, and wherein a second input of said error amplifier is coupled to said collector of said second bipolar transistor.

12. A bootstrapped bandgap voltage reference circuit as recited in claim 11 wherein a resistance of said base-current compensating resistor is determined by the following relationship:

$$R4=2(R2)/P$$

where R4 is a resistance of said base-current compensating resistor, R2 is a resistance of the third resistor, and said P is a ratio of the emitter size of said $V_{BE}$ voltage drop transistor to the emitter size of said first transistor.

13. A bootstrapped bandgap voltage reference circuit as recited in claim 12 wherein said bandgap voltage is about 1.2 volts d.c.

14. A bootstrapped bandgap voltage reference circuit as recited in claim 12 wherein said emitter of said second bipolar transistor is in the range of 2 to 20 times larger than said emitter of said first bipolar transistor.

15. A method for developing a bandgap reference voltage comprising the steps of.

generating a PTAT current with at least two transistors supplied with a base current; and applying said PTAT current to a series connection of a PTAT voltage drop resistor with a bipolar $V_{BE}$ voltage drop transistor, an emitter of said bipolar $V_{BE}$ voltage drop transistor being coupled directly to an emitter of one of said at least two transistors, such that a bandgap voltage $V_{REF}=V_{PTAT}+V_{BE}$ can be developed across said series connection as said PTAT current flows through said series connection, said $V_{PTAT}$ equals a voltage drop across said PTAT voltage drop resistor and said $V_{BE}$ equals a voltage drop across said $V_{BE}$ voltage drop transistor, wherein said base current for said at least two transistors is derived from a base current node located between said PTAT voltage drop resistor and said $V_{BE}$ voltage drop transistor, and wherein said PTAT current is compensated for an effect of said base current flowing through said PTAT voltage drop resistor.

16. A method for developing a bandgap reference voltage as recited in claim 15 wherein said step of generating said PTAT current comprises the step of reducing the effect of said base current flowing through said PTAT voltage drop resistor.

17. An integrated circuit comprising:

at least one bootstrapped bandgap voltage reference circuit, including:

a series connection of a PTAT voltage drop resistor with a bipolar $V_{BE}$ voltage drop transistor, such that a bandgap voltage $V_{REF}=V_{PTAT}+V_{BE}$ can be developed across said series connection when a PTAT current flows through said series connection, said $V_{PTAT}$ equals a voltage drop across said PTAT voltage drop resistor and said $V_{BE}$ equals a voltage drop across said $V_{BE}$ voltage drop transistor, wherein a first node of said PTAT voltage drop resistor is coupled to a $V_{REF}$ output node, a second node of said PTAT voltage drop resistor is coupled to a base current node, a first node of said $V_{BE}$ voltage drop transistor is coupled to said base current node, and a second node of said $V_{BE}$ voltage drop transistor is coupled to ground; and a PTAT current generator coupled to said $V_{REF}$ output node to provide a PTAT current to flow through said series connection, said PTAT current generator including a first bipolar transistor of a first size, and a second bipolar transistor of a second size greater than said first size, wherein a base of said first bipolar transistor is coupled to said base current node of said series connection, an emitter of said first bipolar transistor is directly coupled to said second node of said $V_{BE}$ voltage drop transistor, and wherein a base of said second bipolar transistor is coupled to said base current node by a base-current compensating resistor which compensates said PTAT current to counteract an effect of base current for said first transistor and said second transistor flowing through said PTAT voltage drop resistor to said base current node.

18. The integrated circuit of claim 17, wherein a value for said base-current compensating resistor is determined by the following relationship:

$$R4=2(R2)/P$$

where R4 is the resistance of said base-current compensating resistor, R2 is a resistance of a resistor coupling an emitter of said second transistor to ground, and P is a ratio of the emitter size of said $V_{BE}$ voltage drop transistor to the emitter size of said first transistor.

19. The integrated circuit of claim 18 wherein a resistance of a resistor R0 coupling a collector of said first transistor to said $V_{REF}$ output node is selected as:

$$R0=P(R3)$$

wherein said R3 is a value of the PTAT voltage drop resistor, and said P is a ratio of the emitter sizes of said $V_{BE}$ voltage drop transistor and said first transistor.

20. The integrated circuit of claim 19 wherein a resistance of a resistor R1 coupling a collector of said second transistor to said $V_{REF}$ output node is selected to be about the same as the resistance of resistor R0.

21. The integrated circuit of claim 20 wherein a resistance of said PTAT voltage drop resistor is selected as:

$$R3=(V_{REF}-V_{BE})/I_{3,ideal}$$

where $V_{BE}$ is a voltage drop across said $V_{BE}$ voltage drop transistor, and $I_{3,ideal}$ is an ideal current through said series connection.

22. A bandgap voltage reference circuit, comprising:

a series connection of a PTAT voltage drop resistor with a $V_{BE}$ voltage drop transistor, such that a bandgap voltage $V_{REF}=V_{PTAT}+V_{BE}$ can be developed across said series connection, said $V_{PTAT}$ equals a voltage drop across said PTAT voltage drop resistor and said $V_{BE}$ equals a voltage drop across said $V_{BE}$ voltage drop transistor; and a PTAT current generator including a pair of bipolar transistors which derive their base currents from a base current node between said PTAT voltage drop resistor and said $V_{BE}$ voltage drop transistor, a first bipolar transistor of said pair of bipolar transistor having an emitter coupled directly to an emitter of said $V_{BE}$ voltage drop transistor and directly to ground, said PTAT current generator being coupled to said series connection to provide a PTAT current to flow through said series connection, said PTAT current being compensated by said PTAT current generator to counteract an effect of said base currents flowing through said PTAT voltage drop resistor.

23. A bandgap voltage reference circuit as recited in claim 22 wherein a first node of said PTAT voltage drop resistor is coupled to a $V_{REF}$ output node, a second node of said PTAT voltage drop resistor is coupled to said base current node, a collector of said $V_{BE}$ voltage drop transistor is coupled to said base current node.

24. A bandgap voltage reference circuit as recited in claim 23 wherein said first bipolar transistor has a first size and a second bipolar transistor of said pair of bipolar transistors has a second size greater than said first size, wherein a base of said first bipolar transistor is coupled to said base current node, and wherein a base of said second bipolar transistor is coupled to said base current node by a base-current compensating resistor which compensates said PTAT current to counteract said effect of said base currents flowing through said PTAT voltage drop resistor.

25. A bandgap voltage reference circuit as recited in claim 24 further comprising an error amplifier having inputs coupled to said pair of bipolar transistors and an output coupled to said $V_{REF}$ output node.

26. A bandgap voltage reference circuit as recited in claim 25 wherein a collector of said first bipolar transistor is coupled to said $V_{REF}$ output node by a first resistor, a collector of said second transistor is coupled to said $V_{REF}$ output node by a second resistor, and an emitter of said second transistor is coupled to said ground by a third resistor, wherein a first input of said error amplifier is coupled to said collector of said first bipolar transistor, and wherein a second input of said error amplifier is coupled to said collector of said second bipolar transistor.

27. A method for developing a bandgap reference voltage comprising the steps of:

generating a PTAT current with at least two transistors supplied with a base current; and applying said PTAT current to a series connection of a PTAT voltage drop resistor with a bipolar $V_{BE}$ voltage drop transistor, an emitter of said bipolar $V_{BE}$ voltage drop transistor being coupled directly to an emitter of one of said at least two transistors and directly to ground, such that a bandgap voltage $V_{REF}=V_{PTAT}+V_{BE}$ can be developed across said series connection as said PTAT current flows through said series connection, said VTAT equals a voltage drop across said PTAT voltage drop resistor and said $V_{BE}$ equals a voltage drop across said $V_{BE}$ voltage drop transistor, wherein said base current for said at least two transistors is derived from a base current node located between said PTAT voltage drop resistor and said $V_{BE}$ voltage drop transistor, and wherein said PTAT current is compensated for an effect of said base current flowing through said PTAT voltage drop resistor.

28. A method for developing a bandgap reference voltage as recited in claim 15 wherein said step of generating said PTAT current comprises the step of reducing the effect of said base current flowing through said PTAT voltage drop resistor.

* * * * *

UNITED STATES PATENT AND TRADEMARK OFFICE

CERTIFICATE OF CORRECTION

PATENT NO. 5,619,163

DATED : April 8, 1997

INVENTOR(S) : Koo

It is certified that error appears in the above-indentified patent and that said Letters Patent is hereby corrected as shown below:

CLAIMS:

Column 10, line 63, replace "." with --:--

Signed and Sealed this

Ninth Day of September, 1997

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,619,163

DATED : April 8, 1997

INVENTOR(S) : Ronald B. Koo

It is certified that error appears in the above-indentified patent and that said Letters Patent is hereby corrected as shown below:

Column 7, Line 3, replace "27KΩ" with --27 kΩ--.

Column 7, Line 56, replace "$I_{E3}$ $I_{ES}$" with --$I_{E2}$ $I_{E3}$--.

Column 8, Line 32, replace "cream" with --create--.

Signed and Sealed this

Sixteenth Day of December, 1997

Bruce Lehman

*Attest:*

BRUCE LEHMAN

*Attesting Officer*

*Commissioner of Patents and Trademarks*